United States Patent [19]

Jubenville et al.

[11] 4,167,424

[45] Sep. 11, 1979

[54] TREATMENT OF METAL STRIP WITH ULTRASONIC ENERGY AND APPARATUS THEREFOR

[75] Inventors: Duncan Jubenville, Windsor, Canada; Donald J. Kenney, Mt. Clemens, Mich.

[73] Assignee: National Steel Corporation, Pittsburgh, Pa.

[21] Appl. No.: 830,835

[22] Filed: Sep. 6, 1977

Related U.S. Application Data

[63] Continuation of Ser. No. 685,800, May 12, 1976, abandoned.

[51] Int. Cl.[2] ..... B08B 3/12

[52] U.S. Cl. ..... 134/1; 134/15; 134/122 R; 134/184

[58] Field of Search ..... 134/1, 15, 184, 122 R; 259/DIG. 44

[56] References Cited

U.S. PATENT DOCUMENTS

| | | | |
|---|---|---|---|
| 2,702,260 | 2/1955 | Massa | 134/1 |
| 2,987,068 | 6/1961 | Branson | 134/1 X |
| 3,033,710 | 5/1962 | Hightower et al. | 134/1 |
| 3,240,963 | 3/1966 | Sasaki | 134/1 X |
| 3,433,669 | 3/1969 | Kouril | 134/1 |
| 3,473,791 | 10/1969 | White et al. | 134/102 X |

OTHER PUBLICATIONS

Spring, *Metal Finishing*, Ultrasonic Cleaning and Pickling, Mar. 1964, pp. 66–71.

*Primary Examiner*—Marc L. Caroff

*Attorney, Agent, or Firm*—Shanley, O'Neiland, Baker

[57] ABSTRACT

Method and apparatus in which moving metal strip is treated in a treating solution in an elongated tank having a granite bottom sloping upwardly on each side of the longitudinal center line of the tank and ultrasonic energy is directed downwardly through the moving metal strip to be reflected back and forth between the sloping granite bottom and the surface of the treating solution in a path that extends across the width of the tank and repeatedly intersects the moving metal strip. The minimum number of ultrasonic generating units are possible in an arrangement in which the ultrasonic generating units extend longitudinally of the tank along a line above a marginal portion of the moving metal strip. The sonic generators can be supported in liquid-containing receptacles which extend below the liquid level of the treating solution in the tank. The liquid-holding receptacles can be supported on cover members which extend across the tank and enclose the top of the tank.

37 Claims, 15 Drawing Figures

2
5.
38
26
24
56
22
20
58
22
4.
25
42
44
3.
46
51
50

38
30
28
32
26
56
24
27
56
22
20
58
22
57
25
57
44
46
46
50
51

55
22
56
54
59
54
55

46
52
46
48
52
50

30
34
31
32
26
54

TREATMENT OF METAL STRIP WITH ULTRASONIC ENERGY AND APPARATUS THEREFOR

This is a continuation of application Ser. No. 685,800, filed May 12, 1976, now abandoned.

BACKGROUND OF THE INVENTION

It has already been proposed to pickle, clean and polish metal strip and wires using ultrasonic wave energy in a treating solution which may be an acid, a detergent or a liquid with abrasive particles suspended in the liquid. Examples of prior art U.S. patents in this field are Englehart U.S. Pat. No. 2,894,860, Osterman et al U.S. Pat. No. 3,066,084 and Sasaki U.S. Pat. No. 3,240,963.

It has also been proposed to utilize the reflection characteristics of ultrasonic wave energy to treat objects in treating solutions where the energy is reflected from tank surfaces and the surface of the treating solution. Examples of prior art U.S. patents of this category are Branson U.S. Pat. No. 2,987,068, Hightower U.S. Pat. No. 3,033,710 and Kouril U.S. Pat. No. 3,433,669.

Further it has been proposed to use heavy granite tanks for pickling as described in U.S. Patent to White et al, U.S. Pat. No. 3,473,791.

It is now well known that highly efficient ultrasonic wave energy generators produce a beam of wave energy with only slight divergence, for example 5%, and thus that the effect of the beam of wave energy in a treating solution on objects in its path is localized. It follows that effective treatment of a strip of metal moving through a treating solution with ultrasonic generators directed toward the strip and relying only on direct action of the beam of energy would require an economically prohibitive number of generators. Such use of ultrasonic generators or transducers also runs into problems of standing waves which reduce or even render ineffective the desired action of the ultrasonic energy. Even where reflection of the generated beam of ultrasonic wave energy has been contemplated, attenuation of the energy in the beam by long paths through a treating solution has reduced the effectiveness of such arrangements. As a result the ultrasonic treatment of moving strips of metal has not progressed in industry to the extent that might be expected.

The shortcomings of the prior art practices have been removed or alleviated in the present invention.

SUMMARY OF THE INVENTION

The apparatus of the present invention is for continuously treating moving metal strip with ultrasonic wave energy and comprises a shallow, elongated open top tank, a sloping bottom in the tank the upwardly facing surface of which efficiently reflects ultrasonic energy, sidewalls and end walls in the tank for holding in the tank a shallow body of treating solution having a liquid level above the bottom of the tank, means for introducing the moving metal strip into the treating solution near one end of the tank, moving the metal strip through the treating solution and withdrawing the metal strip from the treating solution near the other end of the tank transducer means having a bottom for generating waves of mechanical vibratory energy at ultrasonic frequency and emanating a beam of the ultrasonic energy out of the bottom of the transducer means, receptacle means having liquid impermeable bottom and side walls for holding a liquid, the bottom wall being formed of ultrasonic energy transmissable material, means for supporting the receptacle means with at least the lower portion of the receptacle means immersed in the solution and above the moving strip, and means associated with the receptacle means for supporting the transducer means in the receptacle means immersed in the liquid in the receptacle means with the beam of ultrasonic energy directed through the ultrasonic energy transmissable material of the receptacle means bottom wall, through the moving metal strip and onto the bottom of the tank.

The apparatus of the present invention also comprises a cover for an elongated open top tank for continuously treating moving metal strip with ultrasonic wave energy which supports receptacle means having liquid impermeable bottom and sidewalls for holding a liquid, the bottom wall of the receptacle being formed of ultrasonic energy transmissible material and means associated with receptacle means for supporting transducer means for generating waves of mechanical vibratory energy at ultrasonic frequency and emanating the beams through the receptacle means bottom wall and through the moving metal strip.

The present invention also involves the method of continuously treating moving metal strip with ultrasonic wave energy comprising providing an elongated open top tank having a sloping bottom, the upwardly facing surface of the bottom having the ability to reflect ultrasonic energy efficiently, providing a shallow body of treating solution in the tank having a liquid level sufficiently above the bottom of the tank to cover the widest metal strip to be treated, introducing the moving metal strip into the body of treating solution, moving the metal strip through the treating solution and withdrawing the metal strip from the treating solution, providing a receptacle holding a body of liquid with at least the lower portion of the receptacle immersed in the treating solution, the bottom wall of the receptacle being formed of ultrasonic energy transmissible material, generating a beam of ultrasonic wave energy in the body of liquid in the receptacle, projecting the beam of ultrasonic energy through the lower portion of the receptacle, through the moving metal strip and onto the bottom of the tank the angle of incidence of the beam of ultrasonic energy on the bottom and the slope of the bottom at the place of incidence of the beam on the bottom being such that the reflected beam passes through the moving strip of metal at a different place from the place where the beam first passed through the metal strip.

The present invention utilizes an elongated, very shallow bath of treating solution coupled with a sloping tank bottom that will reflect ultrasonic wave energy and suspended ultrasonic generators, submerged in water and isolated from attack by the treating solution, directed downwardly so that the beam of generated ultrasonic energy passes through the moving metal strip, impinges on the sloping tank bottom in a direction transverse of strip movement, is reflected upwardly through the moving strip at a different point, is reflected downwardly from the surface of the solution through the moving metal strip at still another point across the width of the strip, impinges again on the sloping bottom, repetition of these reflections acting to repeat the ultrasonic energy treatment of the metal strip across its full width. For best results the generated beam of ultrasonic energy should go through the marginal portion of at least one edge of the strip and be reflected upwardly but in the general direction of the other marginal portion of the strip. Thus width a sloping tank bottom as shown in the drawings, or with the slope being due to an arcuate shape, an ultrasonic generator is positioned over one marginal portion of the strip with the beam directed vertically downward or at an angle toward the intermediate portion of the tank, depending upon the slope of the bottom, so that the marginal portion of one edge of the strip will receive the beam directly from the generator. As shown in the drawings, another generator can be positioned above the marginal portion of the other edge of the strip in a similar manner but arranged so that standing waves are not set up by the two beams of ultrasonic energy.

DETAILED DESCRIPTION OF THE METHOD AND EMBODIMENTS OF THE INVENTION

Although the present invention is applicable to any treatment of metal strip with ultrasonic wave energy, such as pickling steel strip and cleaning or polishing any metal strip, the invention is especially suited to the pickling of steel strip and will therefore be described in this environment.

Figure 1:
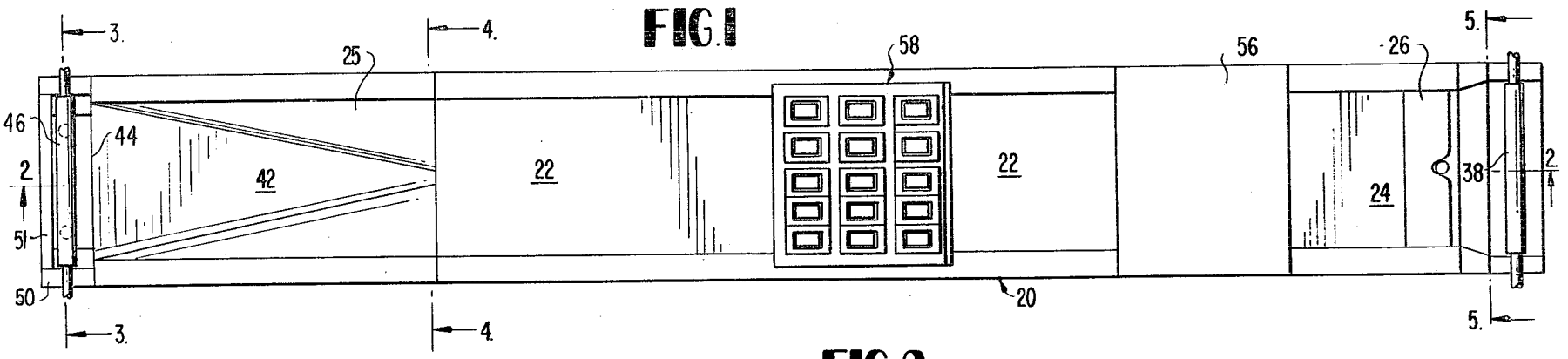
FIG. 1 is a plan view of an elongated tank for treating a moving strip of metal, with parts omitted for simplicity and clarity.
Figure 2:
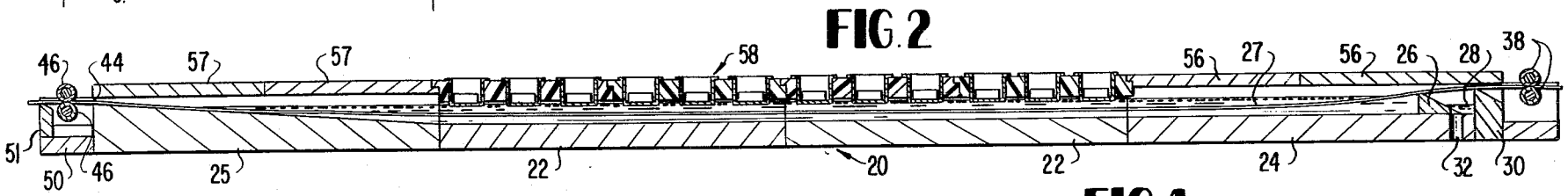
FIG. 2 is a view in longitudinal section taken on the line 2—2 of FIG. 1 with a metal strip shown in position in the tank.
Figure 4:
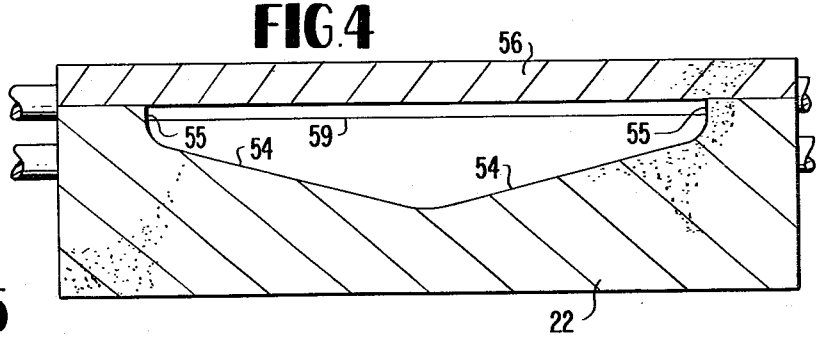
FIG. 4 is a view in cross section taken on the line 4—4 of FIG. 1.
Figure 3:
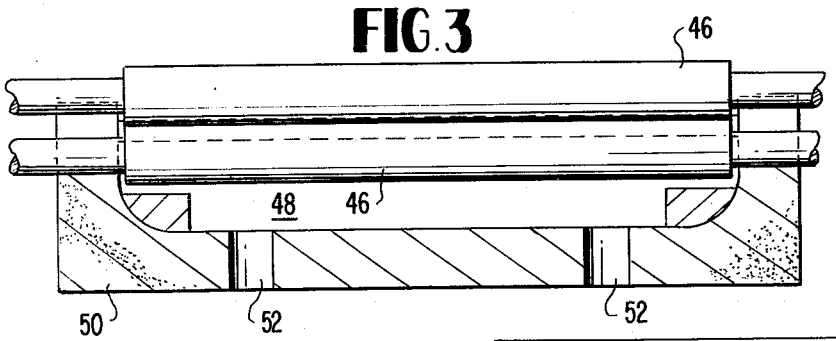
FIG. 3 is a view in cross section taken on the line 3—3 of FIG. 1.
Figure 5:
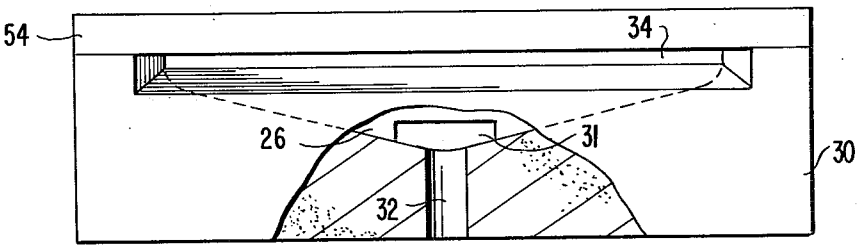
FIG. 5 is a view in cross section taken on the line 5—5 of FIG. 1.

Referring to FIGS. 1 to 5, a long, extremely, shallow pickling tank, indicated generally at 20, is shown, the bottom and side walls of which are formed from four monolithic granite slabs, the middle two slabs being hollowed out to form that portion of tank 20 and the other two being hollowed out to form the two differently shaped end portions of tank 20. Referring particularly to FIGS. 1, 2 and 4, identical monolithic granite slabs are shown at 22. Similarly FIGS. 1, 2 and 5 show a monolithic granite slab 24 similar in shape to slabs 22. Monolithic granite slab 25 the shape of which is evident in FIGS. 1 and 2 forms the other end of tank 20. The slabs 22, 22 24 and 25 are cemented in liquid-tight relation to each other. The moving strip 27, shown in FIG. 2, enters tank 20 from the right hand side in FIGS. 1 and 2 and at this end of tank 20 a specially shaped piece of granite 26 coacts with slab 24 to form a dam or endwall across the rear end of tank 20 over which the pickling solution in the tank can flow into a sump 28 formed by dam member 26 and a granite block 30. Granite block members 26 and 30 are cemented in liquid-tight relation to slab 24 with block 31 bracing dam member 26. A drain 32 leads pickling solution away from sump 28. Granite member 30 has cut in it an opening 34 to admit strip 27 into tank 20, rolls 38, 38 serving to move the strip forward.

At the other end of tank 20 granite slab 25 has an inclined portion 42 which guides strip 36 up and out of tank 20 through an opening 44 at the upper end of the inclined portion 42 to rolls 46 which act in conjunction with rolls 38 to move the strip through tank 20. Sloping portion 42 of granite slab 25 also acts as a dam or endwall to hold the treating solution in the tank and a sump 48 is formed by granite members 50 and 51. As in the case of all the other granite components of the tank, members 50 and 51 are cemented in liquid-tight relationship to each other and to the end of slab 25. Treating solution in sump 48 can drain out through drain openings 52. Although not shown in the drawings, a pickling line incorporating the present invention can include a second tank similar to tank 20 with the two tanks in tandem, tank 20 in such case being the second or final tank for treatment of the steel strip with the strongest acid solution. Since the present invention has its greatest advantage in the final pickling tank, the earlier pickling tank has not been shown. However, pickling solution from sumps 28 and 48 can go on to the earlier tank relative to movement of the strip where the pickling solution need not be as concentrated.

The central portion of tank 20 which is formed by slabs 22, 22 and 24, as best seen in FIG. 4, is deepest along its center line with straight sloping sides 54, 54 merging into upright side walls 55, 55. Obviously the bottom can have an arcuate configuration.

The extremely shallow, open top tank of the present invention has granite slabs forming covers 56, 56 covering the strip entrance end portion of the tank and granite slabs forming covers 57, 57 covering the exit end portion of the tank. Tank 20 slants upward slightly toward the strip exit end so that hydrogen gas evolved during the pickling treatment will not collect under the covers and also because movement of the strip at high speed through the treating solution drags the treating solution toward the exit end of the tank. Covers 57, 57 restrain the pickling solution at that end of the tank from being carried out of the tank in too large quantities.

In lieu of additional granite covers, the central portion of the tank in the present invention is enclosed by plastic covers, indicated generally at 58 in FIGS. 1 and 2, which are resistant to corrosive action by the pickling solution, these plastic covers being designed to hold a plurality of ultrasonic wave energy generators or tranducers for ultrasonic treatment of the strip during its movement through the pickling solution.

In FIG. 1, only one granite cover and one plastic cover are shown in order better to illustrate the tank and its constituent parts but as shown in FIG. 2 the entire end portions of open top tank 20 are covered at one end by granite covers 56, 56 and at the other end by granite covers 57, 57 with the entire intermediate section being closed by the plastic covers 58 to be more specifically described hereunder. The thus-enclosed tank has fumes and evolved gases removed by a conventional suction exhaust system not shown. Fresh pickling solution is added to the bath in the tank at a convenient location near the strip exit end of the tank. Dam member 26 determines the liquid level 59 in the tank although the moving strip drags treating solution out the opening 44 at the other end of the tank. Of course the speed of the strip must be controlled so as not to lower the liquid level below a desired level which can be a couple of inches on the side walls 55 of the tank 20 or in other words, not substantially above the widest strip that can be accommodated by the tank.

Figure 7:
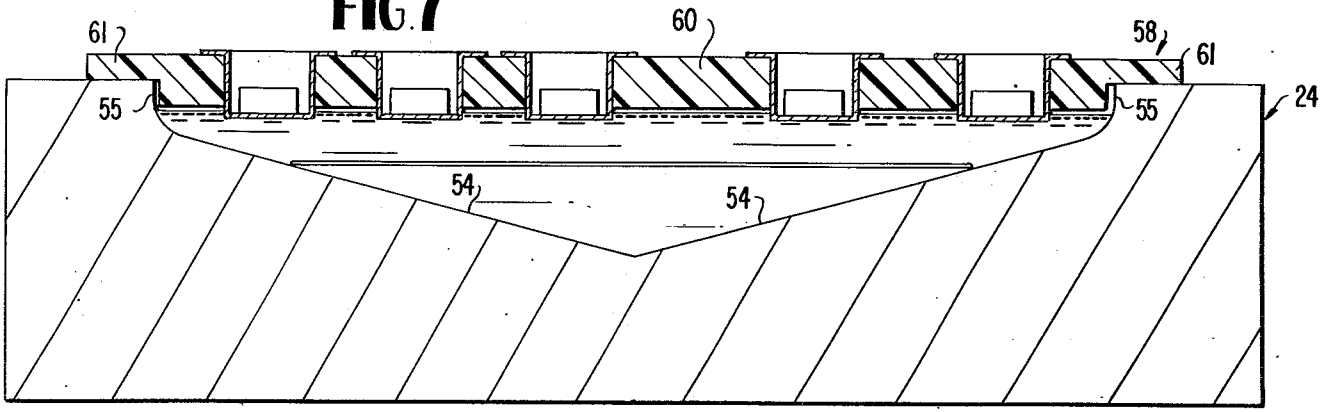
FIG. 7 is an enlarged view in cross section taken on the line 7—7 of FIG. 6.
Figure 12:
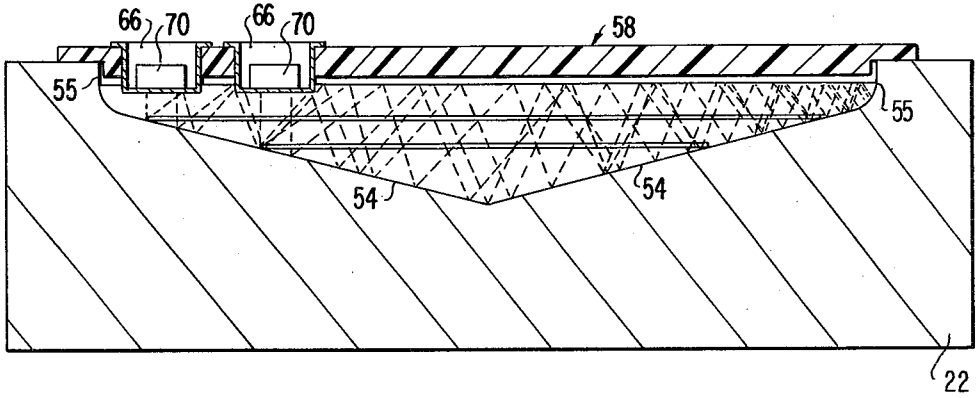
FIG. 12 is an enlarged view in cross section taken on the line 12—12 of FIG. 10.

As shown in FIGS. 2, 7 and 12, although rolls 38, 38 and 46, 46 maintain tension on strip 27, the catenary effect of the weight of the strip causes the strip to droop and the design of tank 20 results in bottom walls 54, 54 of slabs 22, 22 supporting the strip on its edges as it passes through that portion of the tank.

Returning now to the plastic covers illustrated generally at 58 in FIGS. 1 and 2, these covers are conveniently dimensioned the same as granite covers 56 and 57 and as in the case of covers 56 and 57, the bottoms of these covers are spaced above the liquid level 59 of the treating solution to permit flow of fumes and gases along the length of the tank.

Figure 8:
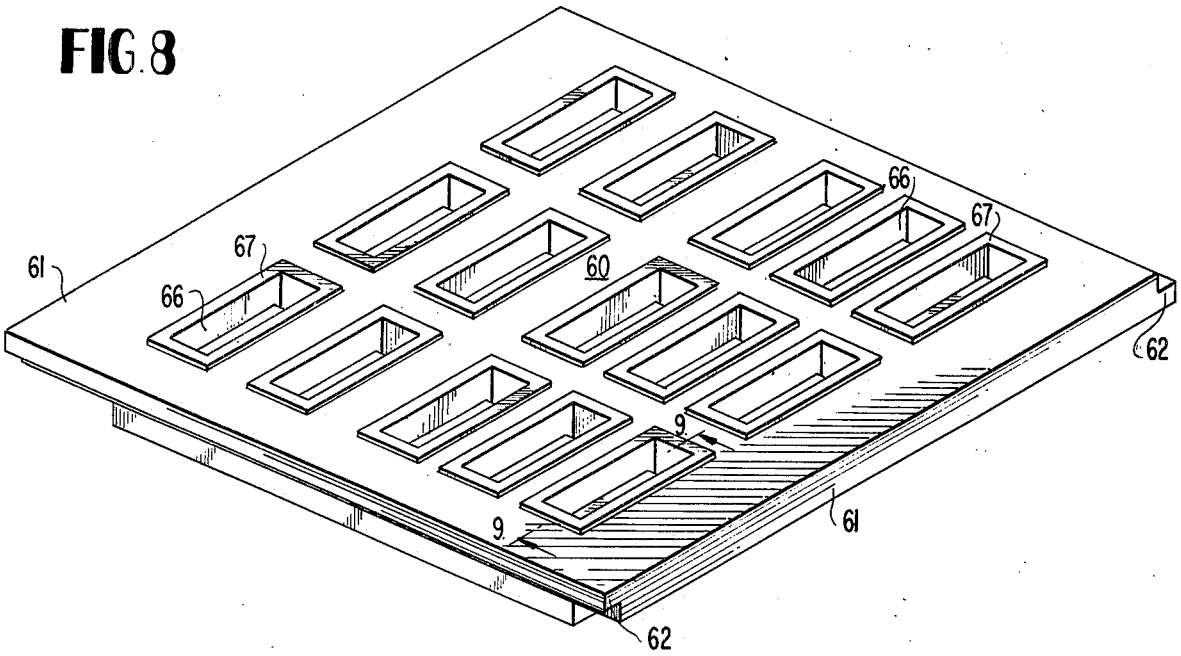
FIG. 8 is a view in perspective of a tank cover showing receptacles for holding transducers.
Figure 9:
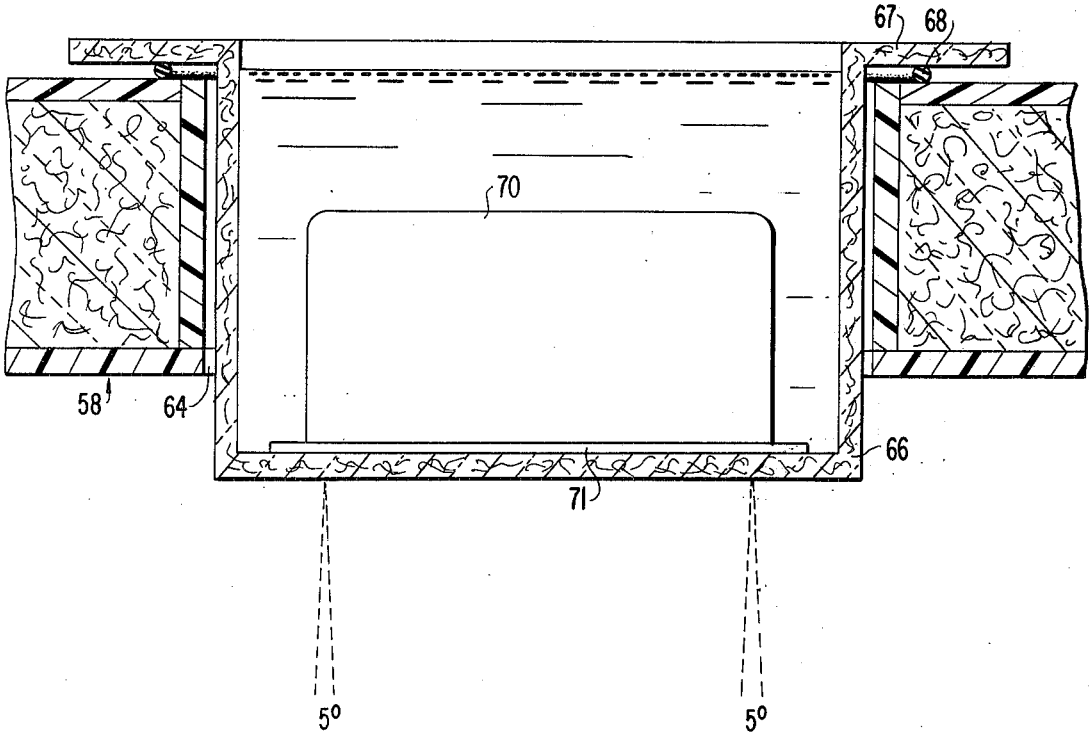
FIG. 9 is an enlarged, fragmentary view in section taken on the line 9—9 of FIG. 8 with the transducer and immersion liquid shown in place.

In the embodiment of the invention illustrated in FIGS. 6, 7, 8 and 9, each of the plastic covers 58 comprises body portion 60 having flanges 61 for supporting the cover on the top surfaces of the side walls 55, 55 of tank 20, the transverse edges of the cover relative to the length of the tank being chamfered at 62 for sealing engagement with adjacent covers. The body portion 60 can be formed in any desired manner but as shown in FIG. 9, it is conveniently formed of sheets of plastic such as polypropylene, which is corrosion resistant in respect to acid used in pickling steel, cemented or welded to form the desired shape. Openings 64 are formed at desired locations through the body portion 60 of each cover and pans or open-top liquid impervious receptacles 66 having supporting flanges 67 resting on the plastic material surrounding the openings are fitted into each opening 64. A resilient gasket 68 seals the joint between receptacle 67 and the plastic material surrounding opening 64 to prevent fumes from the pickling bath escaping to the atmosphere. Receptacles 66 may be formed of fiberglass which is resistant to corrosion by acid used to pickle steel and which transmits ultrasonic wave energy, satisfactory product being molded fiberglass No. 811-101 manufactured by Rockwell International Corporation.

The lower portions and bottomwalls of receptacles 66 extend below the bottoms of covers 60 so as to project below the liquid level 59 of the pickling solution in tank 20. Received within each receptacle 66 and supported therein by any suitable means, in the preferred embodiment the bottom wall of receptacle 66 serving as such means, is an ultrasonic energy generating unit or transducer 70 having a bottom wall 71 resting on the bottom of receptacle 66. Each ultrasonic wave energy generating unit or transducer unit 70 comprises an entirely closed and sealed metal box which contains up to a dozen ultrasonic wave energy generating elements or transducer elements, all arranged in the container with their sonic energy emanating faces directed toward the bottom wall 71 of container 70. The group of ultrasonic wave energy generating elements thus act to produce a combined beam of ultrasonic wave energy emanating downwardly in a direction normal to and through the bottom 71 of container 70. Receptacle 66 is filled with a body of liquid such as water having an upper surface located above the transducer. As thus assembled, the beam of ultrasonic energy generated entirely under the surface of the body of water and being projected from the bottom 71 of the container 70 passes through the bottom of receptacle 66, the fiberglass being chosen as the material of receptacle 66 because it will transmit ultrasonic wave energy efficiently for as long as six months. It has been found that the beam of ultrasonic wave energy emanating downwardly from the bottom 71 of container 70 is substantially nondivergent, a divergence of only 5° on all sides of the beam being the rule.

It will be noted from inspection of FIGS. 7 and 12 that the sloping surfaces of bottom walls 54, 54 terminate adjacent the liquid level of the treating solution, or, in other words, in a horizontal plane contiguous to the bottom walls of receptacle 66. By this arrangement a shallow body of treating solution is achieved whereby wave energy loss in the body of treating solution is minimized.

Figure 6:
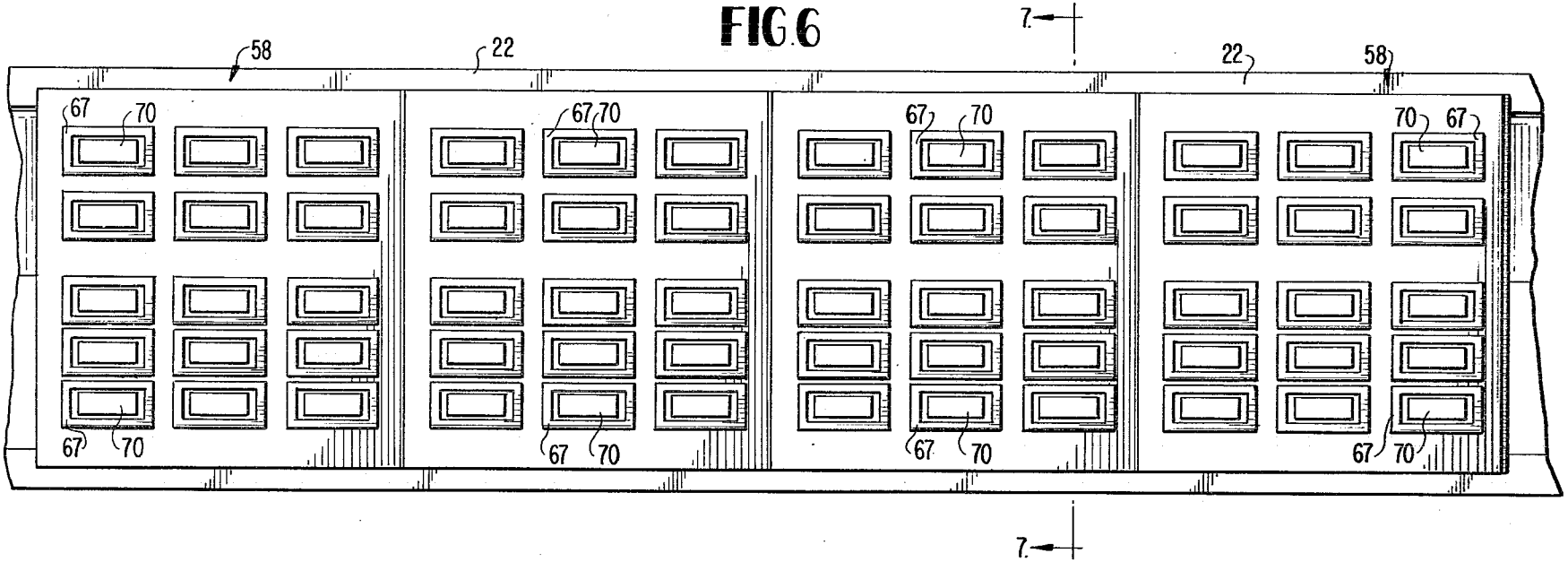
FIG. 6 is an enlarged, fragmentary view in plan of an arrangement of transducers for the central portion of the tank shown in FIG. 2.

The embodiment illustrated in FIGS. 6 and 8 incorporates 15 receptacles 66 and contained ultrasonic transducers in each cover 58 disposed in longitudinal and transverse rows. It will be apparent that with the slight amount of divergence of the ultrasonic energy beam emanated by transducer units 70, strip 27 moving through tank 20 will be subject to direct radiation over an area considerably less than the total area. The applicants have found however that the beams of ultrasonic energy from each transducer 70 pass through the strip and impinge upon a bottom wall 54 from whence they are reflected upwardly at an angle toward the center line of the pickling tank. The extremely shallow bath of the present invention and the nature of monolithic granite coact to give very efficient reflection of energy and each reflected beam again passes through the strip but at another place, from whence it goes to the surface of the liquid there to be reflected backwardly again toward the bottom through the strip at still another place, into engagement with the bottom of the tank and so on across the width of the tank and the strip. In this way, the arrangement of 15 spaced transducer units 70 illustrated in FIGS. 6 to 8 very adequately subjects the entire strip to the action of ultrasonic wave energy and for reasons now well known the pickling action is greatly expedited.

It will be noted that the rows of transducers in the embodiment of FIGS. 6 and 8 are arranged closer together on one side of the strip than the other. Where desired, this arrangement can be reversed in alternate covers but the applicants have found that with the arrangement shown a very complete and uniform pickling is achieved across the width of the strip despite the fact that steel strip has a more tenacious oxide film along its marginal portions than in the center. Looking at FIG. 7 it will be seen that the transducers on the left-hand side of this figure, the lower rows in FIG. 6, send a concentrated massing of ultrasonic wave energy onto and through the strip, regardless of its width. Those portions of the left-hand side of the metal strip in FIG. 7 not subjected to direct ultrasonic radiation are subjected to mass reflected ultrasonic radiation from bottom 54. The transducers which are spaced farther apart on the right-hand side of FIG. 7, the upper transducers in FIG. 6, merely supplement the action of those already described and assure uniform pickling under all the varying conditions of everyday pickling operations.

Figure 10:
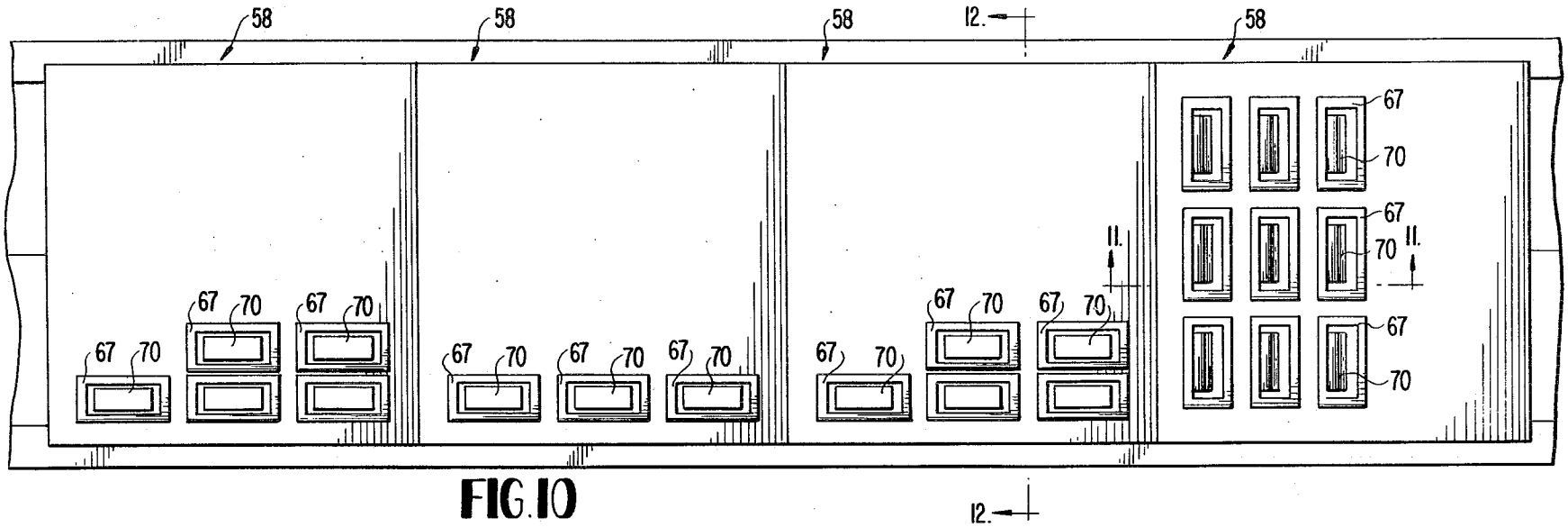
FIG. 10 is a view similar to FIG. 6 showing a different arrangement of transducers.
Figure 11:
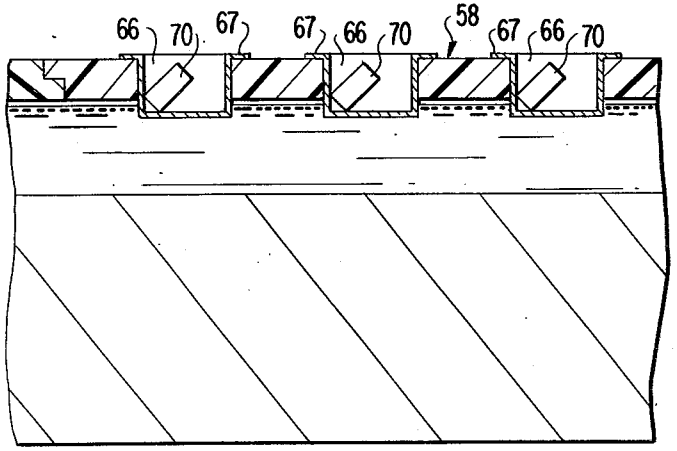
FIG. 11 is a fragmentary, enlarged view in section taken on the line 11—11 of FIG. 10.

In fact, as indicated in FIG. 10, where economy in the use of transducers is the desideratum, much fewer transducers can be used as shown in the arrangements of transducers appearing in the three covers on the left-hand side of FIG. 10. In the case of the embodiment disclosed in FIGS. 10, 11 and 12, the bank arrangement of transducers in the cover on the extreme right can constitute a reserve supply of energy in case a steel strip is highly resistant to normal pickling action or the pickling line speed is increased for some reason or the temperature of the pickling solution is reduced for some reason.

The angled position of the transducers as shown in the extreme right-hand cover 58 of FIG. 10 has been found to be effective under some operating conditions. A variation of this arrangement is shown in the extreme right-hand cover of FIG. 13 and FIGS. 14 and 15. The reason for an effective radiation pattern when the transducers are at an angle as shown in these modifications seems to be that the beam directly impinging on the strip and thereafter on the bottom of tank 20 covers a much larger area of the strip and tank bottom than when the beam is projected vertically on the horizontal strip.

Figure 13:
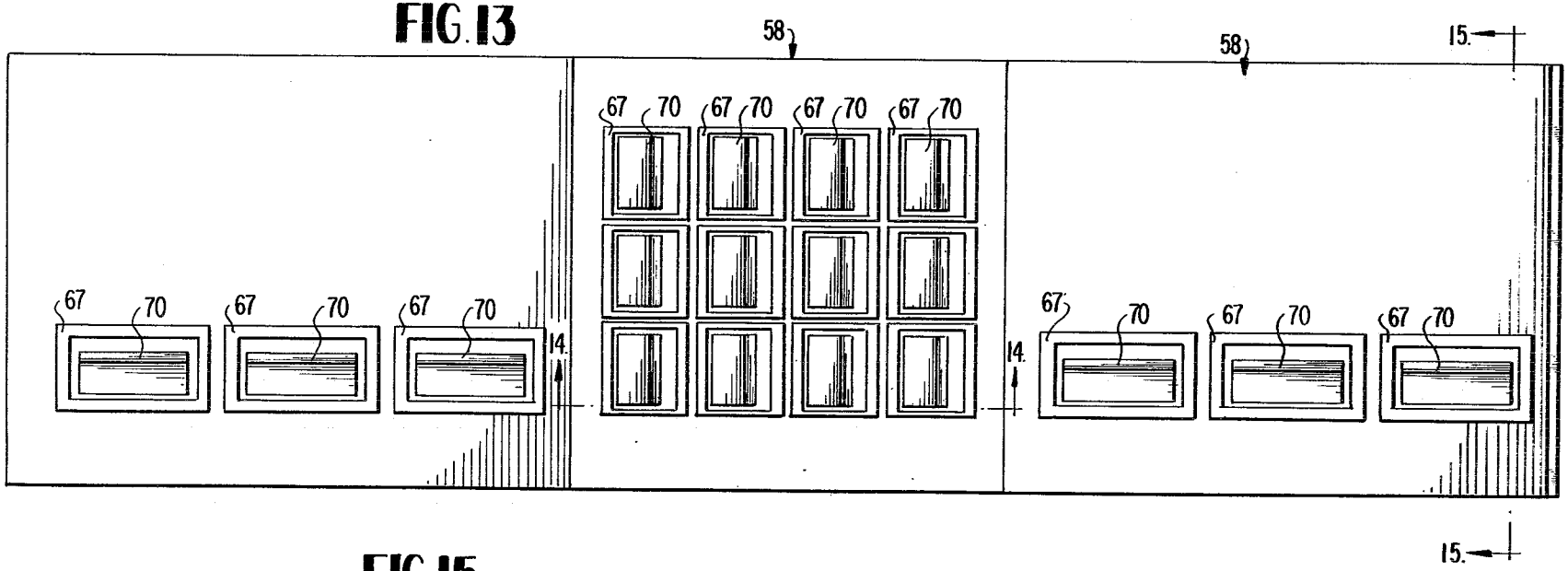
FIG. 13 is a plan view similar to FIGS. 6 and 10 but showing three covers, of another arrangement of transducers.
Figure 15:
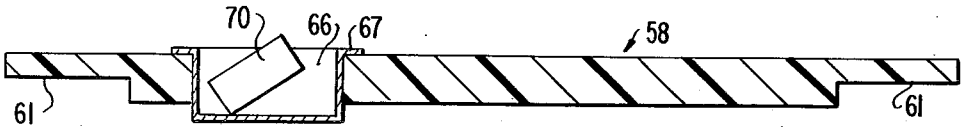
FIG. 15 is an enlarged view in section taken on the line 15—15 of FIG. 13.
Figure 14:
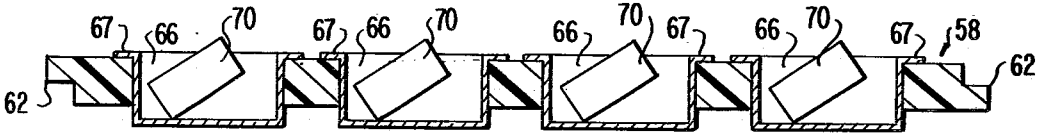
FIG. 14 is an enlarged view in cross section taken on the line 14—14 of FIG. 13.

FIGS. 13 through 15 disclose variations of transducer arrangements which have been found to give satisfactory pickling results.

An examination of the phenomenon present in all the disclosed modifications and which is shown diagrammatically in FIG. 12, shows why ultrasonic wave energy treatment of metal strip in any treating solution can be accomplished with transducers only along one marginal portion of the strip. The dotted lines show the paths of directly radiated ultrasonic energy and the paths of reflected ultrasonic energy from the granite bottom of the tank and from the surface of the treating solution, with the paths of the beams of ultrasonic energy repeatedly passing through the strip all the way across its width.

For some unknown reason it seems that best results are obtained with all the transducer arrangements disclosed in the drawings when ultrasonic wave energy passes through the marginal portion of at least one edge of the strip. Of course in any event it will be apparent that the marginal portion of the strip receives no appreciable ultrasonic energy radiation when the margin of the strip projects outwardly past the beam of the farthest out transducer since the direct beam thus passing through the strip inwardly of the marginal portion of the strip is reflected inwardly toward the center of the strip.

In an example of actual use of this invention in the steel strip pickling field, steel strip is passed at a speed between about 100 feet per minute and about 300 feet per minute through two 50-foot long granite bottom tanks containing a solution of hydrochloric acid. The tanks slope upwardly in the direction of movement of the strip because the strip pulls the solution along with it especially at the higher speeds of pickling possible with the use of ultrasonic energy. The strip varies in width from about 30 inches to about 60 inches. When the narrower widths of strip are being pickled, the transducers or ultrasonic energy generators which are located outside the edges of the strip need not be activated but the cost of operation is negligible and the energy repeatedly reflected from the tank bottom and solution surface passes toward the other side of the tank and thus passes repeatedly through the strip. The first tank in direction of strip movement has the lower concentration of acid, namely between about 3% and about 6%. The second tank in the direction of strip movement needs an acid concentration of up to about 15% hydrochloric acid where the present invention is not used. The ultrasonic energy is utilized in the second tank where the acid concentration is greater. The ultrasonic frequency used is 25,000 cycles. 20,000 Cycles would be more desirable but the only available commercial transducers operate at 25,000 cycles or 40,000 cycles. A lower frequency does better pickling but the sound effects become objectionable below about 20,000 cycles per second. Using the ultrasonic energy the temperature of the pickling solution is dropped down to about 185° to about 190° whereas without the invention the bath must be run at 210° to 215°. Using the invention an acid concentration of about 9% in the second tank is sufficient which results in a saving in cost of acid. The lower bath temperature gives less fumes and better cavitation by the ultrasonic energy. Fresh solution is pumped into the second tank relative to the movement of the strip near the strip exit end and most solution leaving the tank overflows out of the strip entry end of that tank. The greater the speed of the strip the more solution is dragged out of the tank at the strip exit end and this places a limit on strip speed. The amount of solution pumped into the tank considering the overflow at both ends is sufficient to maintain an inch to an inch and a half of depth of solution on the side walls of the tank. Effluent from both ends of the second tank relative to strip movement is collected in a first holding tank and is pumped from there into the first tank relative to strip movement near the strip exit end and, as in the case of the second tank, overflows mostly from the strip entry end of the first tank. This overflow is discarded as spent pickle liquor. The solution is pumped into the system at 150 gallons per minute, the depth of the solution in the deepest part of each tank being maintained at about 9 to 10 inches. In passing through the tanks, although the strip has tension on it, there is a catenary effect which results in the edges of the strip riding on the sloping surfaces of the bottom, with the depth of pickling solution being just sufficient to cover the widest strip to be treated.

The described embodiments and method are to be considered in all respects as illustrative and not restrictive since the invention may be embodied in other specific forms without departing from its spirit or essential characteristics. Therefore the scope of the invention is indicated by the claims rather than by the foregoing description, and all changes which come within the meaning and range of the equivalents of the claims are intended to be embraced therein.

The embodiments of the invention in which an exclusive property or privilege is claimed are defined as follows:

1. The method of continuously treating moving metal strip with ulstrasonic wave energy comprising providing an elongated open top tank having end walls extending along the width of the tank, sidewalls extending along the length of the tank and having a bottom wall sloping downwardly from each sidewall toward the other sidewall, the upwardly facing surface of the tank bottom wall having the ability to reflect ultrasonic wave energy efficiently, providing a body of treating solution in the tank having a top surface located above the bottom of the tank a distance not substantially greater than that required to cover the widest metal strip to be treated, introducing the moving metal strip into the body of treating solution near one end wall of the tank, moving the metal strip through the treating solution and withdrawing the metal strip from the treating solution near the other end wall of the tank, providing a plurality of receptacles, each receptacle holding a body of liquid other than the treating solution and being positioned with the bottom wall of the receptacle in contact with the treating solution and above the moving strip, the bottom wall of the receptacle being formed of ultrasonic wave energy transmissible material, generating a beam of ultrasonic wave energy entirely under the surface of the body of liquid in each receptacle, arranging the plurality of receptacles along the length dimension of the moving metal strip with each of the plurality of beams of ultrasonic wave energy generated in the receptacles directed downwardly toward one of the marginal portions of the moving metal strip, and projecting the generated beam of ultrasonic wave energy through the bottom wall of each receptacle, through said marginal portion of the moving metal strip and onto the bottom of the tank so as to be reflected therefrom, the angle of incidence of the beam of ultrasonic wave energy on the bottom and the slope of the bottom at the place of incidence of the beam on the bottom being such that the reflected beam passes through the moving metal strip at a different place located inwardly of said marginal portion relative to the width of the strip from the place where the beam first passed through the moving metal strip and the reflected beam impinges against and is again reflected from the top surface of the treating solution and passes through the moving metal strip at still another place.

2. The method of claim 1 wherein the sloping bottom of the tank comprises surfaces sloping upwardly on each side of a line extending in the direction of the length dimension of the tank and located in an intermediate portion of the tank, and the strip is moved through the tank with an edge of the strip in contact with each sloping surface of the bottom wall whereby the body of treating solution can be shallow and attenuation of the beam of reflected ultrasonic wave energy minimized.

3. Apparatus for continuously treating with ultrasonic wave energy metal strip moving through a body of treating solution comprising an elongated open top tank having a bottom wall, sidewalls extending along the length of the tank and end walls extending along the width of the tank, the bottom wall of the tank sloping downwardly from each sidewall toward the other sidewall, the upwardly facing surface of the tank bottom wall having the ability to reflect ultrasonic wave energy efficiently, means for introducing the moving metal strip into the treating solution near one end wall of the tank, moving the metal strip along a path through the treating solution and withdrawing the metal strip from the treating solution near the other end wall of the tank, a plurality of transducer means for generating beams of ultrasonic wave energy, each transducer means having a bottom, the beam of ultrasonic wave energy emanating out of the bottom of the transducer means, a plurality of receptacle means, each receptacle means having liquid impermeable bottom and sidewalls for holding a body of liquid other than the treating solution having an upper surface, the bottom wall of the receptacle means being formed of ultrasonic wave energy transmissible material, means above the open top tank for supporting the receptacle means with the bottom wall of the receptacle means in contact with the body of treating solution and above the path of the moving strip, and means associated with each receptacle means for supporting a transducer means in the receptacle means immersed under the upper surface of the body of liquid in the receptacle means with the beam of ultrasonic wave energy directed downwardly toward the bottom wall of the tank, through the ultrasonic wave energy transmissible material of the receptacle means bottom wall, through the path of the moving metal strip and onto the bottom wall of the tank, the plurality of receptacle means being longitudinally arranged along the length dimension of the tank with each receptacle means disposed over the path of one of the marginal portions of the moving strip so as to pass the associated beam of ultrasonic wave energy through the path of said marginal portion of the moving strip, the angle of incidence of each of the beams of ultrasonic wave energy impinging on the bottom wall of the tank being such that the reflected beam of the ultrasonic wave energy passes through the path of the moving metal strip at a place located inwardly of said marginal portion of the moving strip relative to the width of the strip.

4. The apparatus of claim 3 in which the elongated open top tank is formed of monolithic slabs of granite held together in liquid-tight relation.

5. The apparatus of claim 4 in which a plurality of transducer means in receptacle means are arranged transversely of the length dimension of the tank and disposed in spaced relation to each other with the spacing between adjacent transversely disposed transducer means successively increasing between the path of one marginal portion of the strip and the path of the other marginal portion of the strip.

6. The apparatus of claim 5 in which at least some of the transducer units are supported so as to direct the ultrasonic wave energy emanating from the transducer means through the path of the moving strip at an angle of incidence to the surface of the strip of between about 30° and about 60°.

7. The apparatus of claim 6 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

8. The apparatus of claim 7 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

9. The apparatus of claim 8 in which the means for moving the strip through the treating solution positions the strip for movement through the tank with an edge of the strip in contact with each sloping surface of the bottom wall of the tank.

10. The apparatus of claim 3 in which a plurality of transducer means in receptacle means are arranged transversely of the length dimension of the tank and disposed in spaced relation to each other with the spacing between adjacent transversely disposed transducer means successively increasing between the path of one marginal portion of the strip and the path of the other marginal portion of the strip.

11. The apparatus of claim 10 in which at least some of the transducer units are supported so as to direct the ultrasonic wave energy emanating from the transducer means through the path of the moving strip at an angle of incidence to the surface of the strip of between about 30° and about 60°.

12. The apparatus of claim 11 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

13. The apparatus of claim 12 in which the sloping bottom of the tank comprises surfaces sloping upwardly on each side of a line extending in the direction of the length dimension of the tank located in an intermediate portion of the width of the tank, and the upwardly sloping surfaces of the tank terminate in a horizontal plane which is continguous to the bottom walls of the receptacle means.

14. The apparatus of claim 13 in which the means for moving the strip through the treating solution positions the strip for movement through the tank with an edge of the strip in contact with each sloping surface of the bottom wall of the tank.

15. The apparatus of claim 3 in which at least some of the transducer units are supported so as to direct the ultrasonic wave energy emanating from the transducer means through the path of the moving strip at an angle of incidence to the surface of the strip of between about 30° and about 60°.

16. The apparatus of claim 15 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

17. The apparatus of claim 16 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

18. The apparatus of claim 17 in which the means for moving the strip through the treating solution positions the strip for movement through the tank with an edge of the strip in contact with each sloping surface of the bottom wall of the tank.

19. The apparatus of claim 3 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

20. The apparatus of claim 19 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

21. The apparatus of claim 20 in which the means for moving the strip through the treating solution positions the strip for movement through the tank with an edge of the strip in contact with each sloping surface of the bottom wall of the tank.

22. The apparatus of claim 3 in which the sloping bottom wall of the tank comprises surfaces sloping upwardly on each side of the line extending in the direction of the length dimension of the tank located in an intermediate portion of the width of the tank, and the upwardly sloping surfaces of the tank terminate in a horizontal plane which is contiguous to the bottom walls of the receptacle means.

23. The apparatus of claim 22 in which the means for moving the strip through the treating solution positions the strip for movement through the tank with an edge of the strip in contact with each sloping surface of the bottom wall of the tank.

24. The apparatus of claim 4 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

25. The apparatus of claim 24 in which the means for moving the strip through the treating solution positions the strip for movement through the tank with an edge of the strip in contact with each sloping surface of the bottom wall of the tank.

26. The apparatus of claim 4 in which at least some of the transducer units are supported so as to direct the ultrasonic wave energy emanating from the transducer means through the path of the moving strip at an angle of incidence to the surface of the strip of between about 30° and about 60°.

27. The apparatus of claim 26 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

28. The apparatus of claim 27 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

29. The apparatus of claim 28 in which the means for moving the strip through the treating solution positions the strip for movement through the tank with an edge of the strip in contact with each sloping surface of the bottom wall of the tank.

30. The apparatus of claim 4 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

31. The apparatus of claim 30 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

32. The apparatus of claim 31 in which the means for moving the strip through the treating solution positions the strip for movement through the tank with an edge of the strip in contact with each sloping surface of the bottom wall of the tank.

33. The apparatus of claim 10 in which the means for supporting the receptacle means include cover means for closing the open top of the tank, the cover means extending across the top of the tank in spaced relation to the top surface of the body of treating solution, the cover means including means forming a plurality of openings in the cover means for supporting the receptacle means in the openings with the receptacle means closing the openings.

34. The apparatus of claim 33 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

35. The apparatus of claim 34 in which the means for moving the strip through the treating solution positions the strip for movement through the tank with an edge of the strip in contact with each sloping surface of the bottom wall of the tank.

36. The apparatus of claim 10 in which the sloping bottom wall of the tank comprises surfaces sloping upwardly on each side of a line extending in the direction of the length dimension of the tank located in an intermediate portion of the width of the tank, and the upwardly sloping surfaces of the tank terminate in a horizontal plane which is contiguous to the bottom walls of the receptacle means.

37. The apparatus of claim 36 in which the means for moving the strip through the treating solution positions the strip for movement through the tank with an edge of the strip in contact with each sloping surface of the bottom wall of the tank.

* * * * *